United States Patent [19]

Salomon

[11] Patent Number: 4,754,990

[45] Date of Patent: Jul. 5, 1988

[54] PIVOTABLE SKI BINDING ASSEMBLY COMPRISING A BRAKING SYSTEM

[75] Inventor: Georges P. J. Salomon, Annecy, France

[73] Assignee: Salomon S.A., Annecy, France

[21] Appl. No.: 946,084

[22] Filed: Dec. 24, 1986

Related U.S. Application Data

[63] Continuation of Ser. No. 749,718, Jun. 28, 1985, Pat. No. 4,687,221, which is a continuation of Ser. No. 53,774, Jul. 2, 1979, abandoned.

[30] Foreign Application Priority Data

Jul. 4, 1978 [FR] France ..... 78 19920

[51] Int. Cl.[4] ..... A63C 7/10

[52] U.S. Cl. ..... 280/605; 280/620

[58] Field of Search ..... 280/604, 605, 618, 620; 188/5–8

[56] References Cited

U.S. PATENT DOCUMENTS

| | | | |
|---|---|---|---|
| 3,432,179 | 3/1969 | Marker et al. | 280/630 |
| 3,489,424 | 1/1970 | Gertsch | 280/605 X |
| 3,909,024 | 9/1975 | Salomon | 280/605 |
| 3,917,297 | 11/1975 | Fruh . | |
| 4,061,357 | 12/1977 | Salomon | 280/605 |
| 4,163,569 | 8/1979 | Horn | 280/618 X |
| 4,168,849 | 9/1979 | Salomon | 280/605 |
| 4,210,342 | 7/1980 | Krob et al. | 280/605 X |

FOREIGN PATENT DOCUMENTS

| | | | |
|---|---|---|---|
| 375932 | 5/1922 | Fed. Rep. of Germany | 280/605 |
| 2413099 | 10/1975 | Fed. Rep. of Germany . | |
| 2531466 | 2/1976 | Fed. Rep. of Germany . | |
| 2462234 | 5/1976 | Fed. Rep. of Germany . | |
| 2525945 | 12/1976 | Fed. Rep. of Germany . | |
| 2234910 | 1/1924 | France . | |
| 1554728 | 1/1969 | France . | |
| 2213784 | 8/1974 | France . | |
| 2228505 | 12/1974 | France . | |
| 2258876 | 8/1975 | France . | |
| 2278364 | 2/1976 | France . | |
| 2299052 | 8/1976 | France . | |
| 2304366 | 10/1976 | France . | |
| 431349 | 8/1967 | Switzerland | 280/636 |

*Primary Examiner*—Robert J. Spar
*Assistant Examiner*—Donald W. Underwood
*Attorney, Agent, or Firm*—Sandler & Greenblum

[57] ABSTRACT

A device adapted to be mounted on a ski comprising a first maintenance element, a pivotable plate adapted to pivot around an axis substantially perpendicular to the ski comprising a second maintenance element; and a braking assembly. The braking assembly comprises at least one braking element adapted to shift between active and inactive positions and at least one boot-sensitive element adapted to shift the braking element to the inactive position as the boot is mounted on the ski.

The braking assembly may be arranged such that it is either stationary with respect to the pivotable plate or such that it pivots together with the pivotable plate.

Stopping means for limiting rotation of the plate may also be provided.

37 Claims, 9 Drawing Sheets

PIVOTABLE SKI BINDING ASSEMBLY COMPRISING A BRAKING SYSTEM

This is a continuation of application Ser. No. 749,718, filed 6/28/85, now U.S. Pat. No. 4,687,221, issued Aug. 18, 1987, which is a continuation of Ser. No. 53,774, filed 7/2/79, now abandoned.

BACKGROUND OF THE INVENTION

1. Field of the Invention

The present invention relates to a ski binding assembly for use with skis which is adapted to make it possible to maintain a ski boot mounted on a ski. The binding assembly further comprises a braking system which is preferably of the pivotable type.

2. Description of Prior Art

Various pivotable ski bindings have been proposed in which one of the ends of the ski boot is maintained on the ski by a first maintenance element fixed on the ski which permits the ski boot to escape laterally when the boot is subjected to a torsional force while the other end of the ski boot is retained by a second maintenance element which permits vertical release. The second element is mounted on a pivotable plate on the ski which pivots around an axis substantially perpendicular to the ski. The pivotable plate moves together with the boot along the plane of the ski.

SUMMARY OF THE INVENTION

It is an object of the invention to provide a ski binding which comprises first and second maintenance elements for maintaining the ski-boot mounted on the ski which operate in conjunction with a pivotable plate to permit release of the ski-boot when the boot is subjected to a torsional force.

It is a further object of the invention to provide a device in which the pivotable plate is automatically returned to the position adapted to receive the ski boot without requiring any further manipulation by the user.

These and other objects are fulfilled by means of the device of the invention which comprises a device adapted to be mounted on a ski. The device comprise a first maintenance element; a pivotable plate adapted to pivot around an axis substantially perpendicular to the ski the plate itself comprising a second maintenance element. The first maintenance element and the pivotable plate are each adapted to be mounted on a ski such that the first and second maintenance elements may serve to securely maintain the ends of a ski-boot mounted on the ski while laterally releasing the boot when the boot is subjected to a torsional force relative to the ski. A braking assembly is also provided which comprises at least one braking element adapted to shift between active and inactive positions. The braking element is normally biased to the active position. The assembly further comprises at least one boot-sensitive element adapted to shift the braking element to the inactive position as the boot is mounted on the ski.

In a first embodiment of the invention the braking assembly is arranged such that it pivots together with the pivotable plate.

According to the invention stopping means may be additionally be provided for limiting rotation of the plate. The stopping means is adapted to cooperate with an element when at least one of the braking elements is in the active position whereby the pivotable plate is realigned so as to permit insertion of the ski-boot between the first and second elements without manual manipulation of the pivotable plate.

Yet a further aspect of the invention relates to a device adapted to be mounted on a ski which again comprises a first maintenance element and a pivotable plate which itself comprises a second maintenance element. A braking assembly mounted to pivot together with the pivotable plate is also provided. The assembly comprises at least one braking element adapted to shift between active and inactive positions and at least one boot-sensitive element adapted to shift the braking element to the inactive position. Stopping means directly mounted on the ski may also be provided so as to limit rotation of the plate.

In yet another aspect of the invention, the device comprises a braking assembly which, instead of being mounted on the pivotable plate, is adapted to be directly mounted on the ski.

BRIEF DESCRIPTION OF DRAWINGS

With reference to the annexed drawings.

SUMMARY OF PREFERRED EMBODIMENTS

Figure 1:
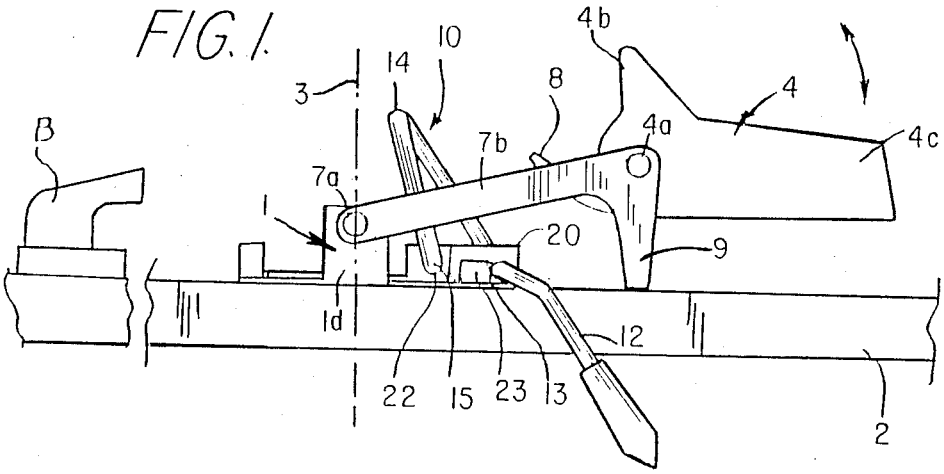
FIG. 1 is a side view of a first embodiment of the device in the centered position ready for insertion of the boot.

According to the invention, pivotable bindings and the like are provided with a braking system for the ski which offers two main advantages. First, the braking system does not entail any manual manipulation during insertion of the boot such as, for example, the manual lifting of the brake to a position permitting skiing. Second, the system facilitates reinsertion of the boot particularly after a fall, while avoiding any risk of a false fitting of the boot in the binding which greatly increases the security for the skier.

According to a first aspect of the invention, the braking assembly is mounted on the pivoting plate or on a portion integral with the plate so as to move together with the plate during movement of the plate and comprises at least one braking element adapted to shift between an inactive position wherein the brake is raised above the lower plane of the ski and an active position in which it projects beneath the ski, the braking element being elastically biased towards its active position; and a boot sensitive element which senses the presence of the boot and whose activation by insertion of the boot causes the braking element to be lifted to the inactive position.

According to another aspect of the invention, the device comprises stopping means for stopping the pivoting plate which, in the active position of the braking element, i.e., when the element protrudes under the ski, causes a portion integral with the pivoting plate during rotation to cooperate with a portion integral with the ski in a manner so as to maintain the plate in a position substantially aligned with the longitudinal axis of the ski, or in a centered position, which is the position corresponding to insertion of the boot between the first and second maintenance elements longitudinally spaced along the longitudinal axis of the ski.

By following the above arrangements, one is assured that insertion of the boot will always be performed from a position which is convenient to the skier and that the skier will have to occupy himself neither with the rearrangement of the plate, and consequently the position of the braking assembly, nor with manipulation of the braking assembly itself.

Naturally, when the boot has been inserted, neither the braking assembly nor the stopping means, nor the return means act to interfere with or prevent the free rotation of the pivotable plate which is necessary for reasons of security.

Advantageously, the stopping means may be either distinct from the braking assembly or, on the contrary, comprise a portion of the braking assembly.

Furthermore, according to a preferred embodiment of the invention, the device comprises means resulting in the automatic return of the pivotable plate to the centered (or aligned) position ready for insertion of the boot after the plate has been displaced with respect to its centered position.

With reference to the annexed drawings, identical elements will be identified by the same reference numerals in each of the embodiments shown.

The first embodiment of the invention will now be described with reference to FIGS. 1–5. As may be seen from the drawings, a ski 2 is illustrated and is provided with a first maintenance element B adapted to cooperate with the front end of a ski boot 5. This first maintenance element B is attached to the ski and serves as a shoulder or strap for the boot so as to prevent it from moving longitudinally along the ski while, nevertheless, permitting the boot to laterally escape particularly during the exertion of a torsional force on the boot relative to the ski. Furthermore, as shown by the figures, a pivotable plate assembly designated generally as 1 is also mounted on the ski which comprises a second maintenance element 4 for the opposite end of the boot, i.e., the heel in the example shown.

It should be noted that the first and second maintenance elements for the boot, although illustrated with reference to specific embodiments, may nevertheless assume any appropriate form in which the second maintenance element vertically assures release and permits reinsertion of the boot.

The pivoting plate assembly 1 comprises a fixed pivot 1*a*, immobilized on the ski by screws 1*b*, which constitutes an axis of rotation, shown as 3 perpendicular to the upper surface of the ski and situated substantially along the longitudinal axis Y—Y′ of the ski surface. The rotatable plate 1*c* is rotatably mounted on the pivot 1*a*. The rotatable plate comprises two ears or upstanding flanges 1*d* aligned along the X—X′ axis substantially perpendicular to the longitudinal axis Y—Y′ of the ski when the binding is in the insertion position shown in FIG. 2.

Two lateral arms 6*b* and 7*b* are jointed at 6*a* and 7*a* on the flanges 1*d*. These two arms are united by a common shaft which comprises a pivoting body 4*c* of the second maintenance element 4 which has a known structure and which is adapted to rock or pivot around the shaft 4*a* to be brought into a position where it presses against the sole of the ski boot by virtue of its jaw 4*b* (see FIG. 3) or to open to the position shown in FIG. 1. It will be noted immediately that the body 4*c* preferably comprises a pedal 8 making it possible to automatically reinsert the boot in the second maintenance element. Furthermore, on the interior of the body 4*c* is arranged a conventional locking system which needs not be described in any detail at this point, reference being made to French Pat. No. 2,258,876, filed Jan. 28, 1974, the disclosure of which is incorporated herein, for further details.

When the second maintenance element is in the position shown in FIG. 1, i.e., without a boot on the ski, it rests on the upper surface of the ski by means of a support 9 extending from the lateral arms 6*b* and 7*b*.

The embodiment of FIGS. 1–5 ensures several functions, i.e., a maintenance function and a liberation function of the boot by virtue of the maintenance element 4; a braking function of the ski after the ski has been separated from the boot by virtue of a ski brake generally shown as 10 which will be described in further detail, and the function of maintaining the pivotable plate in the centered position ready for insertion of the boot.

Figure 2:
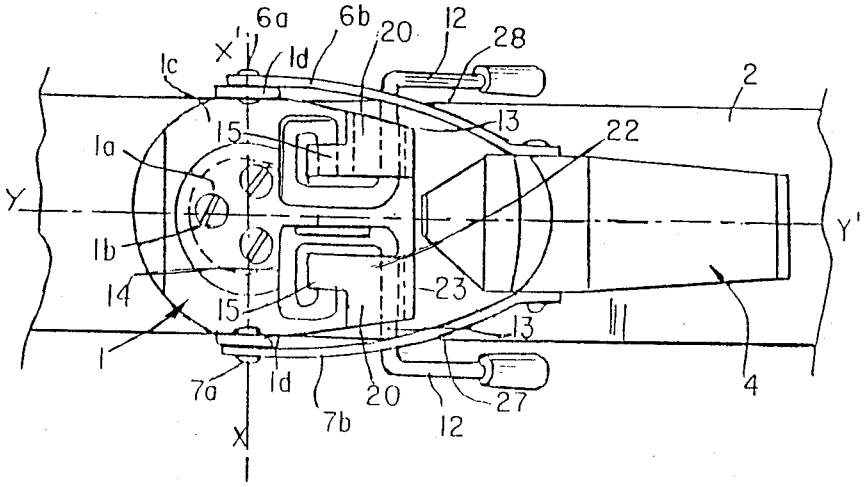
FIG. 2 is a planar view of the device of FIG. 1.

As is seen more particularly in FIG. 2, the braking assembly 10 comprises two independent portions arranged symmetrically with respect to the longitudinal axis Y–Y′ of the ski and situated in the zone where the heel of the boot is adapted to be fitted, i.e., in front of the maintenance element 4.

Each of these portions of the brake comprises well-known structures which need not be described in further detail. It should be noted that for purposes of the invention equivalent structures may likewise be used.

It need only be noted that each of these portions of the brake is constituted by a metallic spring wire which is bent and shaped in a fashion so as to assume an equilibrium position which is that shown in FIG. 1 towards which the wire tends to return on its own in the event that it is deformed elastically.

Figure 3:
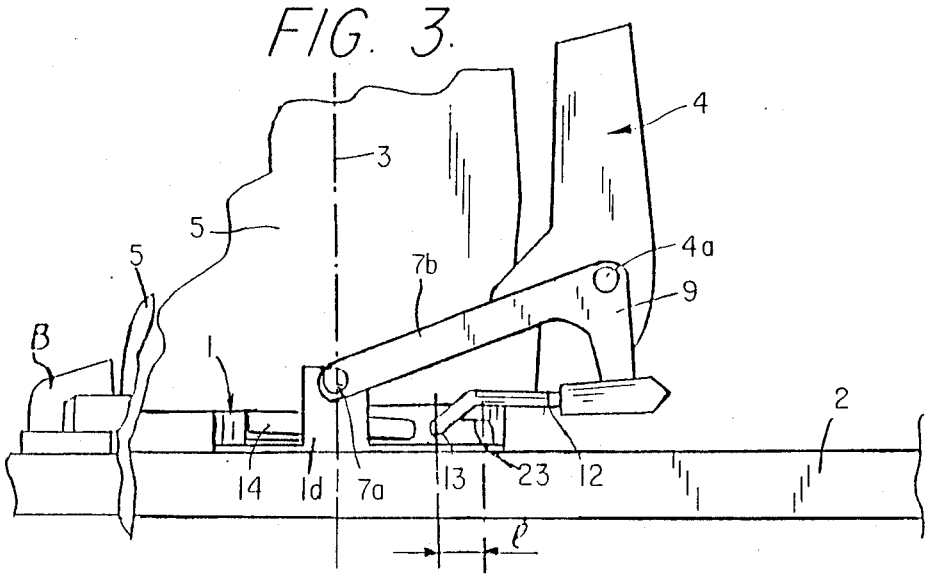
FIG. 3 is an elevational view of the device with the boot inserted.
Figure 4:
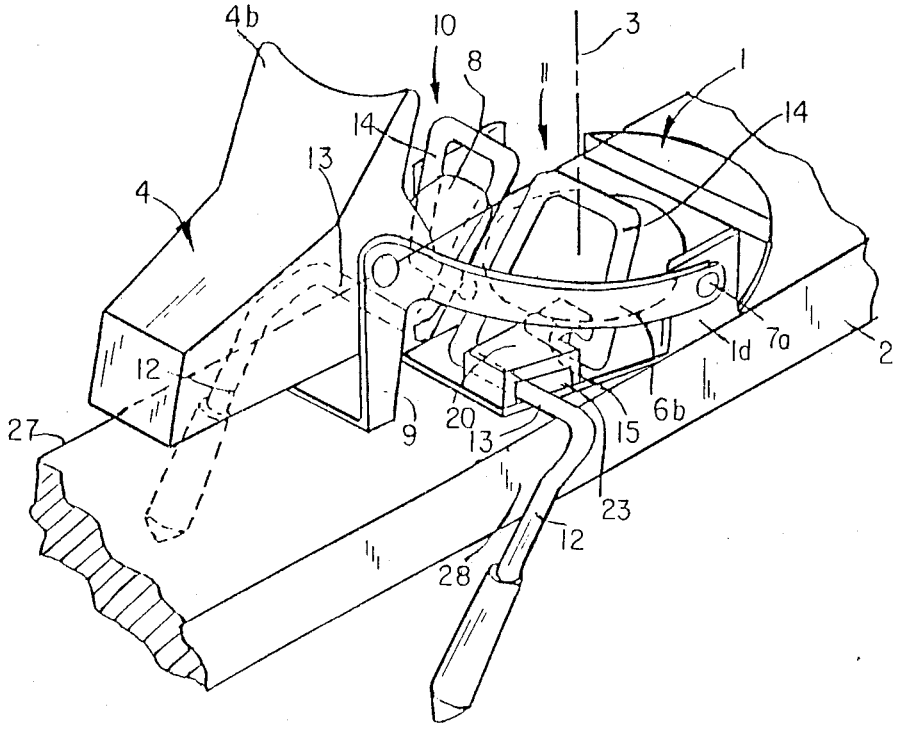
FIG. 4 is a perspective view of the first embodiment of the invention in the centered position ready for insertion of the boot (the boot not yet inserted)
Figure 5:
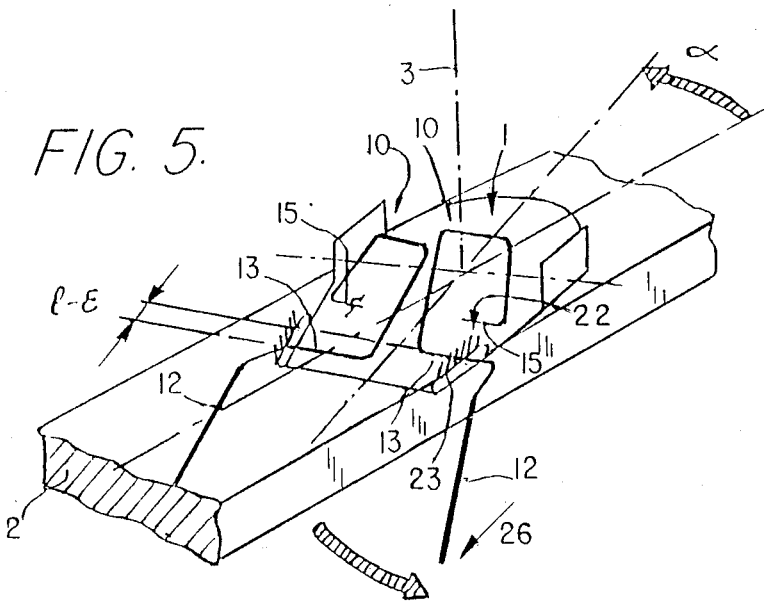
FIG. 5 is a schematic illustration of the manner in which the first embodiment of the invention operates.

The invention should not be considered as being limited to the braking assembly shown and may indeed comprise any other appropriate structure, particularly, the structures illustrated in French Application Nos. 2,304,366; 2,278,364; and 2,299,052. It need only be stated that each of the portions of the brake comprises a braking element 12 laterally extending along the side of the ski connected to a bit or shaft 13 which extends substantially transverse to the Y–Y′ axis of the ski. This shaft is itself connected by a length of wire in the form of a buckle 14 arranged above the plate 1*c*, the buckle ending in a second shaft 15 substantially parallel to the shaft 13. The buckles 14 act as deactivation elements sensitive to the presence of the boot. The shafts 13 and 15 are arranged in an assembly element 20 integral with the pivotable plate 1*c*. In FIGS. 1–3, the shaft 15 is mounted in a pivotable fashion in the hole 22 of the element 20 while the shaft 13 is arranged in a slidable and jointed manner so as to be able to move in an elongated slit 23 of the element 20. By virtue of such an arrangement, the buckles 14 of the brake elements are normally lifted to the position shown in FIG. 1 which corresponds to an active braking position for the braking elements 12 which project beneath the lower plane of the ski. It will be understood that during insertion of the boot on the ski, the sole of the boot will exert a pressure on the buckles 14 and press them against the rotatable plate 1c. This movement causes the elastic deformation of the buckles 14 and the raising to an inactive position of the braking elements 12 for skiing.

As shown in FIG. 3, when in the inactive ski position, the braking elements do not substantially disturb the rotation of the pivotable plate 1*c* around the axis 3 of the pivot 1*a*, particularly during a lateral release of the boot in the plane of the ski, because the braking elements are lifted above the upper surface of the ski.

It will further be noted that it is advantageous to utilize the type of brake shown with which one is able to avoid any and all manipulations of the brakes when the boot is being inserted into the binding, the lifting of the braking elements occurring automatically by virtue of the simple pressure of the boot against the ski.

Furthermore, in the situation where one utilizes independent brake elements as shown in FIGS. 1–5, one is assured that one of the two braking elements will automatically come to the braking position regardless of the angular position of the pivotable plate. Thus, as shown more particularly in FIG. 5, after the liberation of the boot, the pivotable plate is biased with respect to the longitudinal axis of the ski and the portion of the brake situated on the right when looking at FIG. 5, comes to an active braking position while the other portion of the brake remains in an inactive position when the corresponding braking element is shouldered on the upper surface of the ski. It should be noted that when the pivotable plate 1 is in the position shown in FIG. 5, the snow cooperating with the braking element 12 in the braking position will furnish a force on the braking element 12 in the direction shown by arrow 26 which causes the plate to pivot to bring it back to the centered position ready for insertion of the boot, i.e., in the position which is shown in FIGS. 1–4. It will additionally be noted that in, the absence of a boot on the ski, because the braking elements 12 are directed towards the bottom of the ski, they assure by cooperation with the lateral corresponding edges 27 and 28 of the ski, a maintenance of the pivotable plate 1*c* in the centered position ready for insertion of the boot. In other words, this arrangement avoids the necessity of manually repositioning the plate prior to the insertion of the boot which is necessary with conventional systems which are not equipped with braking systems mounted on the pivoting plate.

Figure 6:
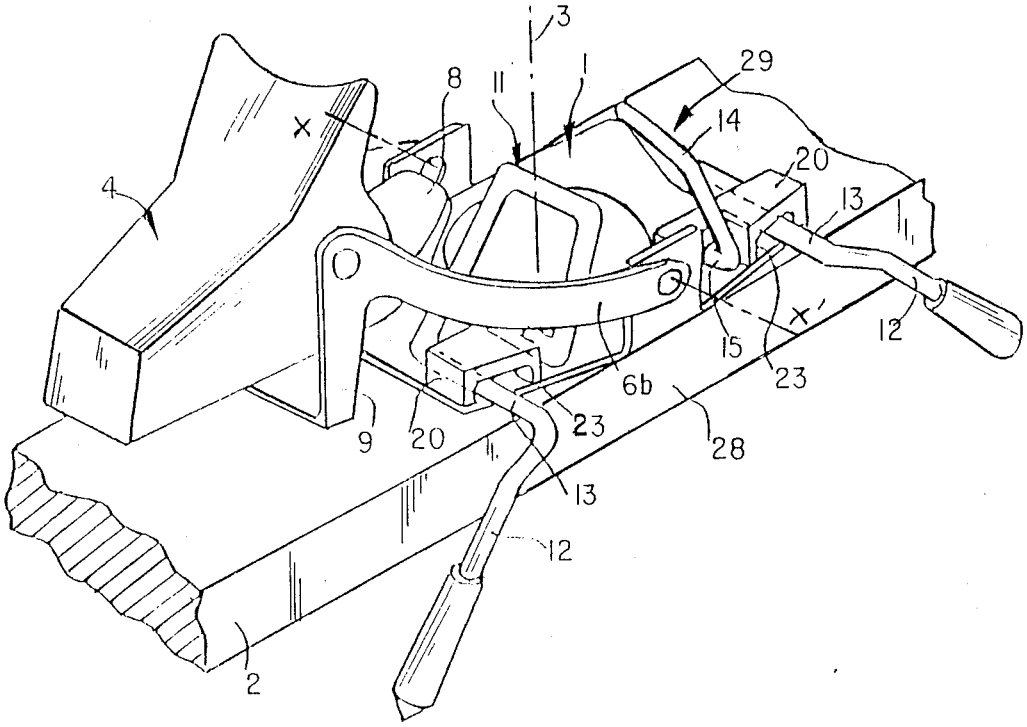
FIG. 6 is a perspective view of a second embodiment of the invention.
Figure 7:
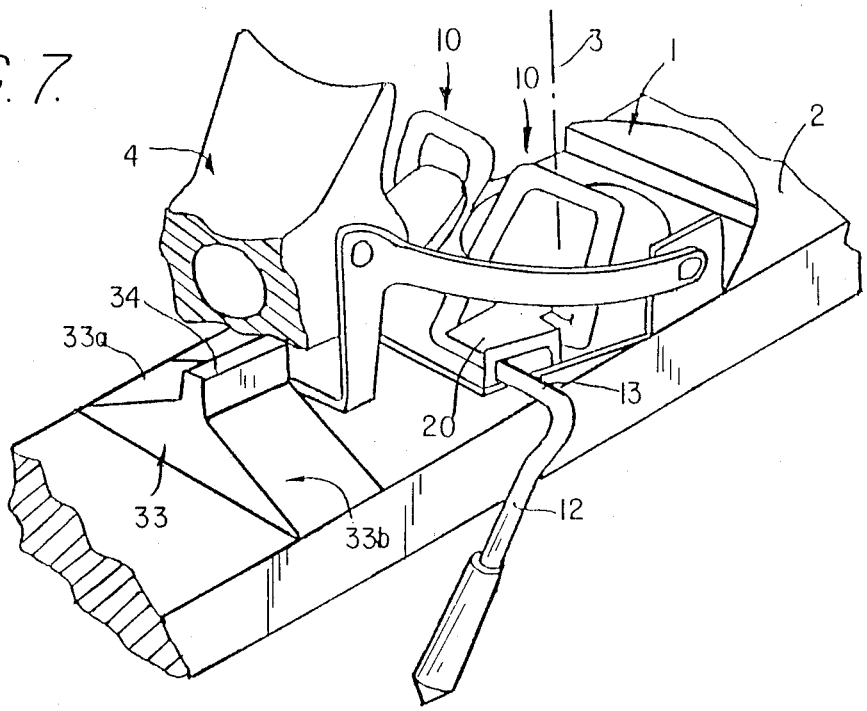
FIG. 7 is a perspective view of a third embodiment of the invention as compared with FIG. 4, further comprising repositioning means for placing the pivoting plate in the centered position for insertion of the boot.

The embodiments of FIGS. 6–17 equally comprise a pivotable plate equipped with a second maintenance element for the boot which has been represented in FIGS. 6 and 7, but which is not shown in FIGS. 8–17 for purposes of simplicity.

The embodiment of FIG. 6 differs from that of FIGS. 1–5 essentially in that the braking assembly is constituted by two independent braking elements which are respectively designated in a general fashion by reference numerals 11 and 29, these two devices being identical to the braking portions 10 of FIGS. 1–5. However, instead of being arranged symmetrically with respect to the longitudinal axis Y–Y′ of the ski, the elements are symmetrical with respect to the vertical plane passing through the axis X—X′ of the pivoting plate 1*c*. In other words, as shown in FIG. 6, they are arranged on the same side of the ski. As a result, these two portions of the brake 11 and 29 cooperate with the same lateral edge 28 of the ski so as to assure the maintenance in the centered position of the pivotable plate 1*c*.

Figure 11:
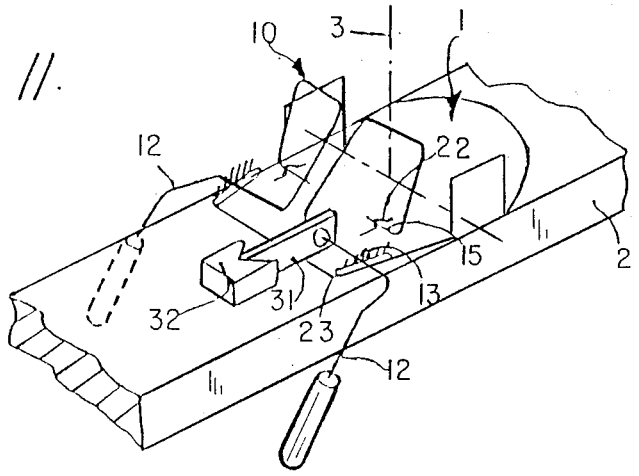
FIGS. 11 and 12 schematically illustrate the operation of a fourth embodiment of the invention.
Figure 12:
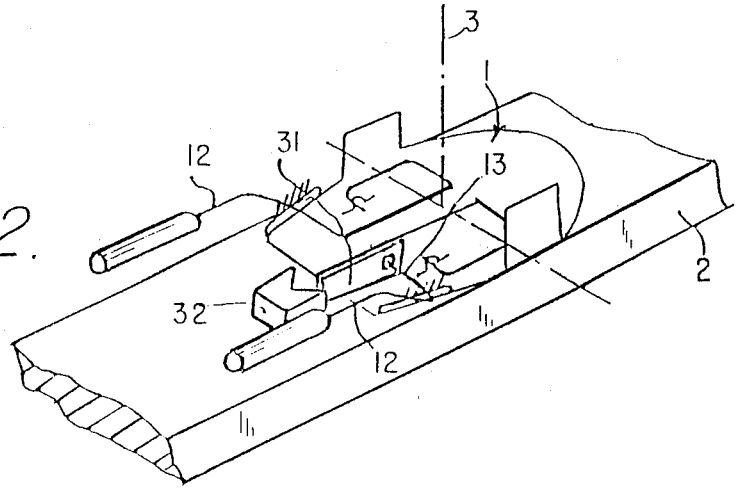

FIGS. 11 and 12 schematically illustrate a further embodiment of the invention in which the means for assuring the maintenance in the centered position of the pivotable plate are different from those of FIGS. 1–6. In this embodiment, it is a moveable element 31 associated with the brake of the ski and more particularly with the shaft 13 which can be moved in the oblong cutout 23 of the plate, which cooperates with a centering and locking element 32 integral with the ski. This element 32 comprises a V-shaped cutout as viewed from above along its surface facing the moveable element 31. It may be seen that when the brake is in the active braking position, the element 31 is blocked in the element 32 (see FIG. 11) and prevents any rotatable displacement of the plate 1. To summarize, as may be seen from FIG. 12, when the brake is in the inactive position for skiing, movement of the shaft 13 of the brake causes the displacement of the moveable element 31 which disengages from the V-shaped cutout of the element 32 and makes possible the free rotation of the plate 1.

FIGS. 7–10 and 13–16 illustrate embodiment which, besides the function of maintaining the plate in the centered position, assure the supplemental function of the automatic return of the pivotable plate to the centered position for insertion of the boot when the boot is not in place on the ski and the pivotable plate 1 is located in a position angularly offset with respect to its position for insertion of the boot.

In the embodiment of FIGS. 7–10 which is similar to that of FIGS. 1–5, an upstanding guiding element designated generally as 33 is attached to the ski. The guiding element comprises two upstanding lateral ramps, inclines or slopes 33*a* and 33*b* which slope from the central longitudinal axis of the ski towards each of the lateral edges of the ski.

Figure 8:
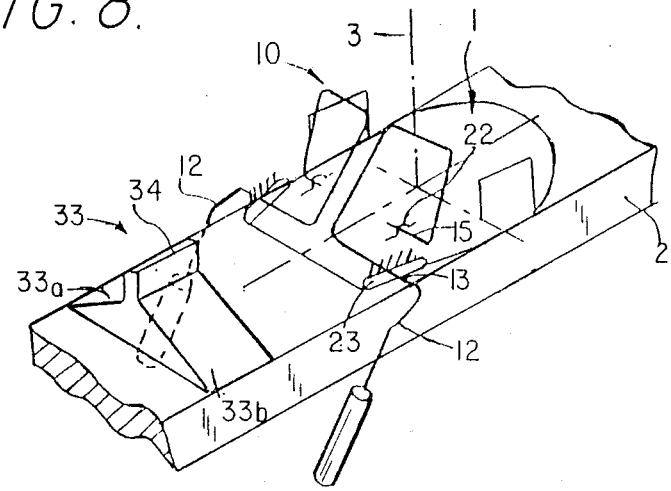
FIGS. 8, 9 and 10 schematically illustrate the operation of the device of FIG. 7.
Figure 9:
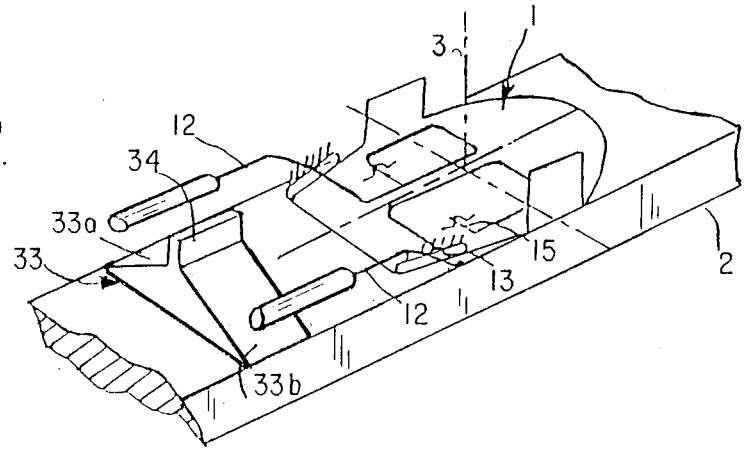
Figure 10:
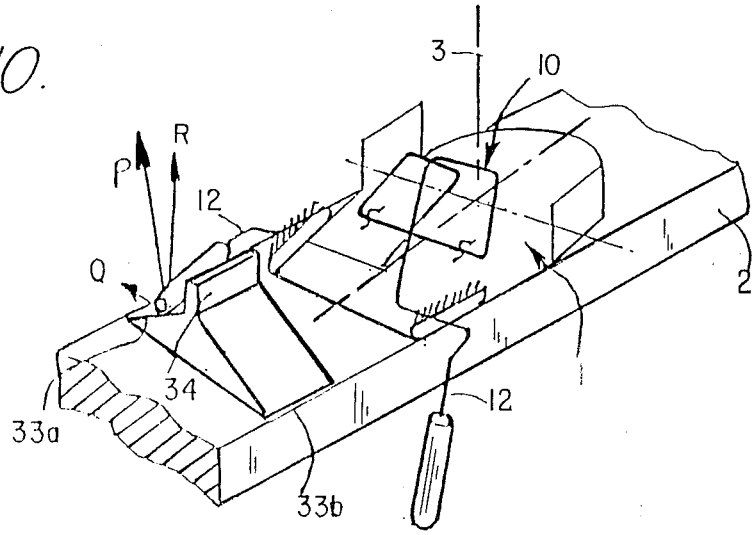

Furthermore, the two ramps or inclines 33*a* and 33*b* are separated by an upstanding stop or projection 34. The operation of the device illustrated in FIG. 7 is schematically shown in FIGS. 8–10. In FIG. 8, the braking elements 12 are in the active position, i.e., there is no boot in the ski. In this situation, as has been previously indicated, the pivotable plate 1 is maintained centered on the ski by virtue of the cooperation of the braking elements 12 with the lateral edges of the ski 2. FIG. 9 illustrates the brake when the boot is in the binding. As shown, the braking elements 12 are lifted above the ski and the element 33 does not interfere with the rotation of the pivotable plate 1 when rotated by an angular amount sufficient for disengagement. When a disengagement or injection results, one of the braking elements 12 abuts (FIG. 10) against one of the slopes (33*a* in the example shown). Since after separation of the boot and the ski, the braking element 12 is elastically drawn downwardly, i.e., to its active braking position, it rests against the ramp 33*a* and the action the ramp on the element 12 is a force P perpendicular to the ramp which may be broken down into vertical and lateral component forces R and Q respectively. The lateral horizontal component Q acts to push the braking element outwardly, which will automatically bring the pivotable plate 1 to the centered position, i.e., to the position shown in FIG. 8.

It will be seen that the stop 34 acts essentially to avoid any risk of the element 12 extending beyond the median plane of the ski. Thus it should be noted that this stop may be eliminated if such is desired.

Figure 14:
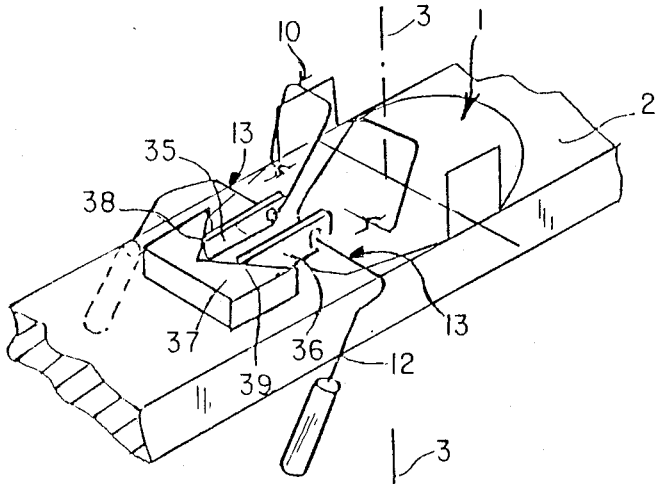
FIGS. 14, 15 and 16 schematically illustrate the operation of a sixth embodiment assuring the repositioning and the maintenance in position of the pivoting plate.
Figure 15:
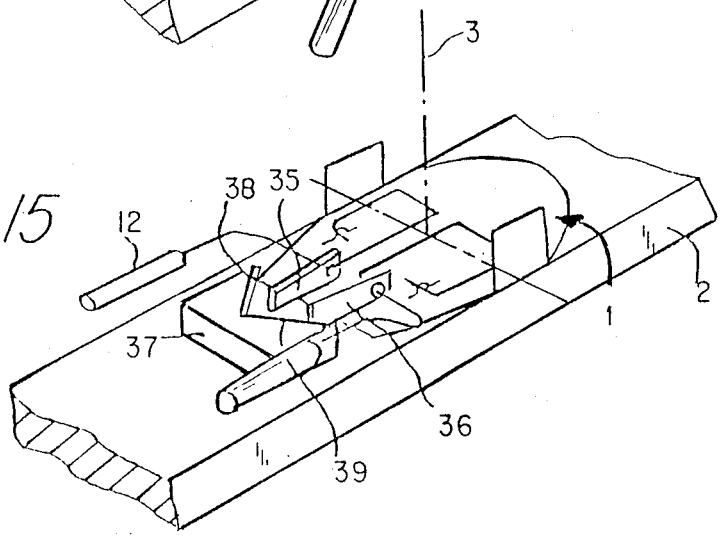
Figure 16:
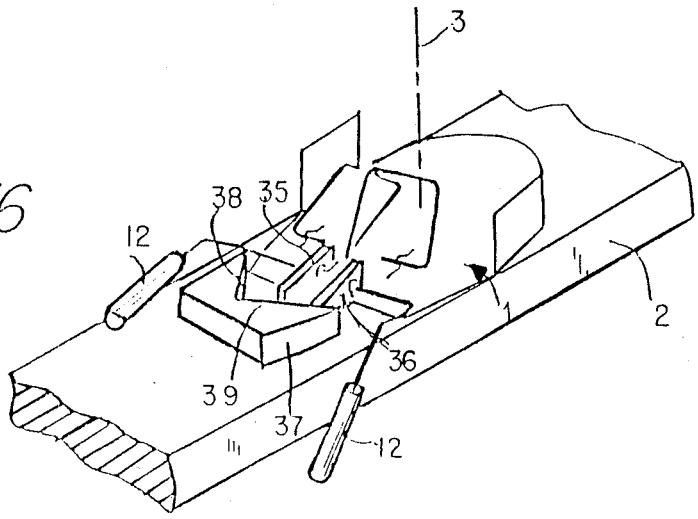

FIG. 14–16 schematically illutrate an alternative embodiment permitting the automatic repositioning of the pivotable plate 1. The braking assembly shown schematically in this embodiment is identical to that envisaged for the embodiments of FIGS. 1–5. On each of the translationally moveable shafts or bits 13 of the two portions of the brake is mounted a moveable element 35–36 which cooperates with an element 37 integral with the ski and whose front portion has two ramps or slopes 38 and 39 converging towards the longitudinal axis of the ski and with which the moveable elements 35 and 36 cooperate. The mode of operation of this embodiment is similar to that of FIGS. 11 and 12.

Figure 13:
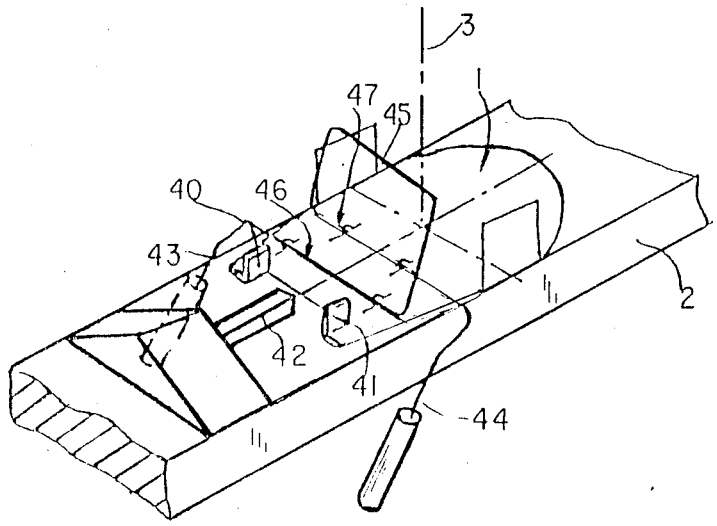
FIG. 13 is a schematic illustration of a fifth embodiment comprising a shoulder or step for angularly limiting the rotation of the pivoting plate.

FIG. 13 represents an alternative embodiment in which the limiting of the rotation of the pivotable plate 1 occures by virtue of two projections 40 and 41 provided on the plate 1 and which cooperate with a small corresponding bar 42 arranged along the longitudinal axis of the ski and integral therewith. This small bar acts as a shoulder for the projections 40 and 41. In this embodiment, an alternative embodiment of the brake is illustrated in which the braking elements 43 and 44 depend on one another because they are both part of the same spring wire bent in a fashion to form shafts 46 and 47 which are substantially parallel and pivotable in the cutouts of the plate 1. These shafts 46 and 47 are connected to one another by an elastic buckle 45 which is deformable and which is arranged above the plane of the plate 1.

Figure 17:
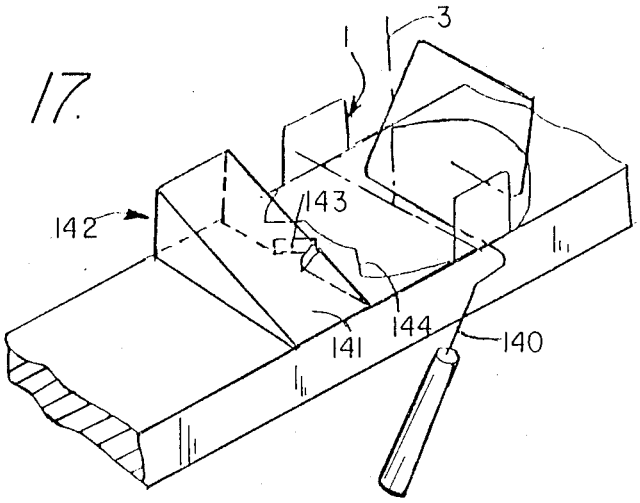
FIGS. 17 schematically illustrates a seventh embodiment of the invention.

FIG. 17 shows yet another embodiment in which a single braking element 140 arranged laterally at the level of the pivoting axis 3 of the pivoting plate 1. This braking element is made of a metallic spring wire bent in a fashion so as to have two pivotable shafts in the plane of the plate and attached by a deformable buckle situated above the plane of the ski.

A fixed element 142 is mounted on the ski. This element comprises a ramp 141 which by virtue of its cooperation with the braking element 140, makes possible the automatic return of the plate 1 to the position in which the boot may be inserted after a lateral release. Furthermore, a projection 143, also integral with the ski, acts as a stop for the shoulders 144 of the pivotable plate 1 so as to limit its angular rotation.

The embodiments shown in FIGS. 18–21 illustrate a situation wherein the maintainance of the plate is obtained by cooperation between an element carried by the plate (a portion of the second maintenance element) and an element carried by the ski (i.e., for example a portion of the braking assembly which is this case is mounted directly on the ski).

On the ski 2 is pivotably mounted around the axis 3 of the plate 1 on which is mounted as in the preceeding examples, the second maintenance element 4 by means of lateral arms 6*b*–7*b* joined at 6*a*–7*a* on the uprights 1*d* of the plate. A braking assembly generally designated as 50 is not carried by the plate as in the preceeding examples but is attached on the ski by virtue of a plate having a base 54 rendered integral with the ski by virtue of screw 53. The braking device can be of any appropriate type comprising braking elements or spades 52 and stirrup 51 situated above the ski and sensitive to the presence of the ski boot. The maneuvering of the of this stirrup 51 (acting as a pedal) causes the activation of the spades or protrusions 52 pivotably mounted with respect to the ski. In the example shown, the braking device comprises a u-shaped stirrup and is of the type described and shown in the French Pat. No. 2,234,910 filed June 29, 1973 in the name of the present inventor, the disclosure of which is incorporated herewith, and need not be described in further detail. It need only be noted that the brake is jointed via the shafts 52*a* lodged in the plate 54 and that it is returned to the braking position shown in FIGS. 18–20 by a compression spring (not shown) which acts as shown in the previously mentioned French Patent.

Naturally, one may use a braking device of the same types as those of the preceding examples as well as any other appropriate braking device.

Figure 18:
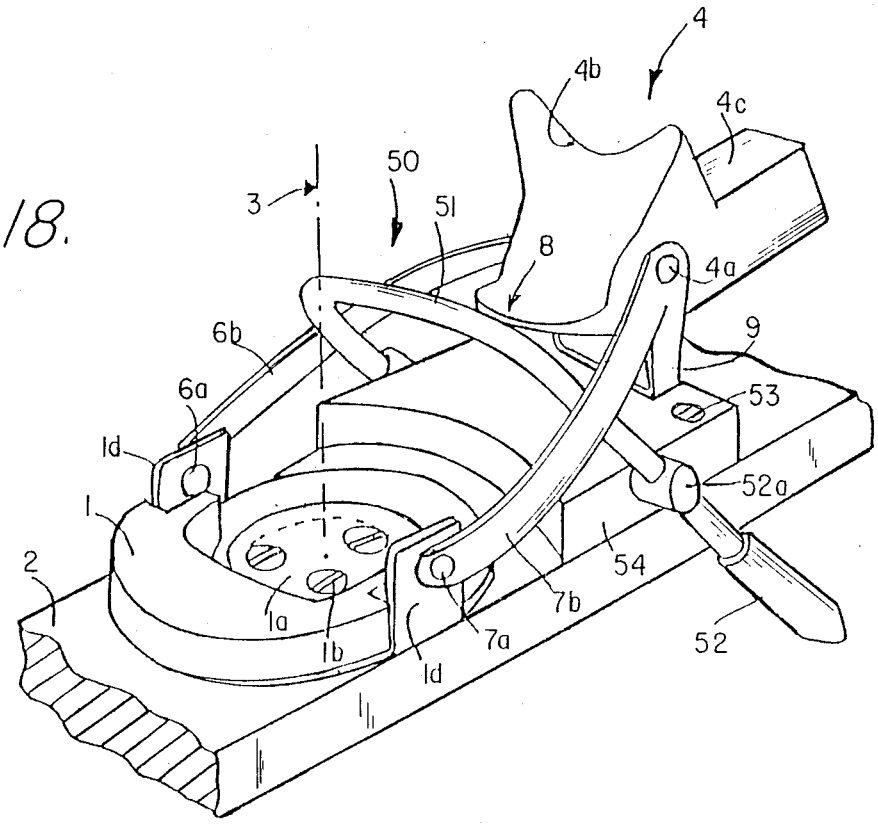
FIG. 18 is a perspective view of an eighth embodiment of the invention.
Figure 19:
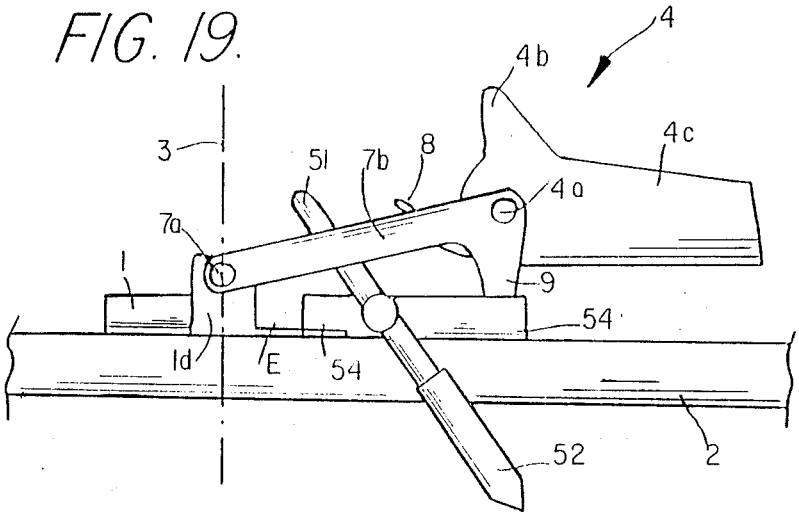
FIGS. 19 and 20 are lateral and planar views respectively, of the embodiment of FIG. 18.
Figure 20:
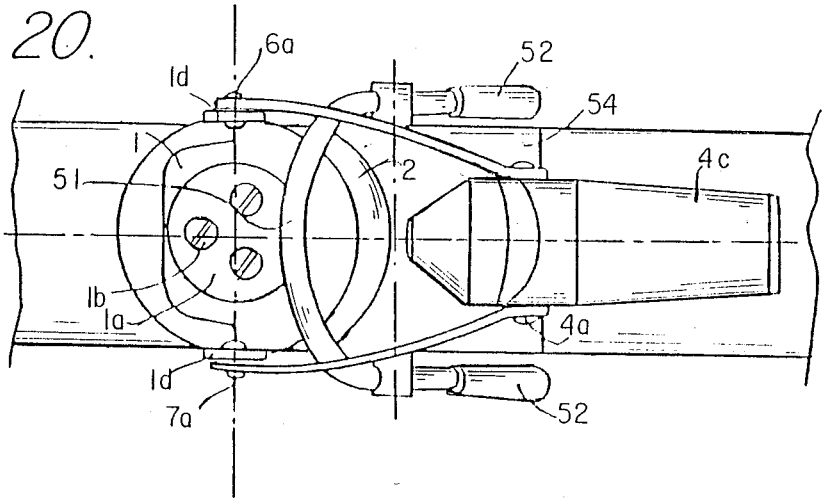

The centered position which corresponds to insertion of the ski boot is shown in FIGS. 18, 19 and 20. As shown, the brake is in the active braking position and the braking elements 52 project beneath the ski while the pedal 51 which is sensitive to the presence of the ski boot is lifted. It may also be seen that the pedal 51 is arranged between the two lateral arms 6*b*–7*b* of a maintenance element 4. There is thus cooperation between the pedal 51 with the lateral arms 6*b*–7*b* to constitute the stopping means of the pivotable plate which, in this case, is maintained in the centered position corresponding to insertion of the boot by abutment of the arms 6*b*–7*b* against the stirrup pedal 51.

Figure 21:
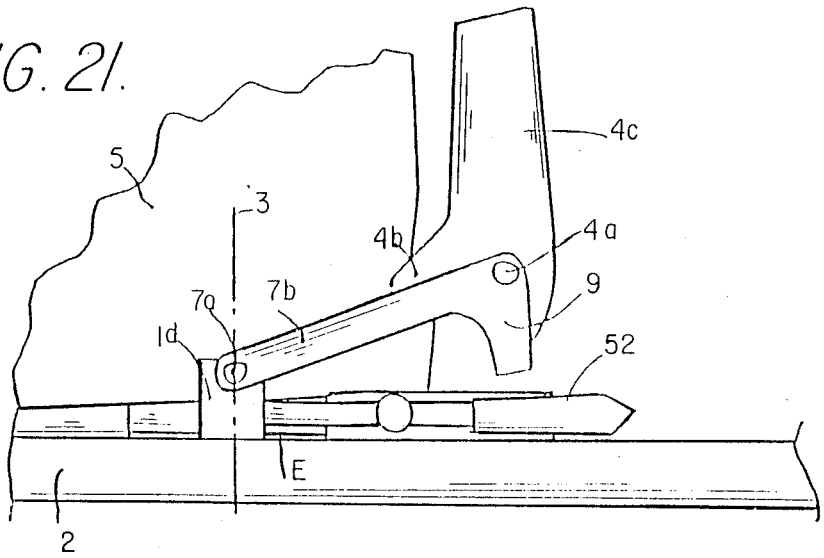
FIG. 21 illustrate the device of FIGS. 18–20 after the boot has been inserted.

FIG. 21 corresponds to a position in which the boot has been inserted. The brake is arranged in the inactive position for purposes of skiing and the pivotable plate is no longer stopped from turning by the pedal because the pedal 51 assumes its place under the boot in the space E (FIGS. 19 and 21) provided above the pivot 1a between the fixed plate 54 and the pivotable plate 1 without interfering with rotational movement of the pivotable plate.

It should be noted that during release, by applying pressure on the pedal 51 the pivotable plate is automatically recentered by virtue of cooperation between the pedal and the lateral arms. This cooperation results by virtue of the curved shape of the pedal which defines a cooperation slope or ramp with reference to the lateral arms.

It should be understood that the invention is not limited to the means specifically disclosed and that other means may also be used. Thus, it is possible to use maintenance elements 4 for the ski boot which are different than the type specifically disclosed. Furthermore, other types of brakes, with or without lateral retraction of the braking element(s).

Furthermore, it should be noted that although the device of the invention has been described with reference to the ski on which it is mounted, it is the device itself as well as its use in combination with the ski or the ski and boot which each constitue the various inventive aspects of the invention.

While the invention has been described with respect to particular embodiments and means, it shoud be understood that the invention is not limited to the means specifically disclosed and that all equivalent means may be substituted without departing from the scope of the invention as defined by the claims.

What is claimed is:

1. A device adapted to be mounted on a ski, said device comprising:

(a) a first maintenance element;

(b) a pivotable plate, adapted to be aligned with said ski, and adapted to pivot around an axis substantially perpendicular to said ski, while remaining secured to said ski, said pivotable plate comprising a second maintenance element wherein said first maintenance element and said pivotable plate are each adapted to be mounted on a ski such that said first maintenance element and said second maintenance element may serve to securely maintain the ends of a ski boot mounted on said ski while laterally releasing said boot when said boot is subjected to a torsional force relative to said ski thereby misaligning said plate; and (c) a braking assembly comprising:

(i) two independent braking elements adapted to shift between active and inactive positions, said braking elements being positioned behind said axis on either lateral side of said ski and normally biased to the active position; and (ii) at least one boot-sensitive element adapted to shift the braking elements to the inactive position as said boot is mounted on said ski;

and wherein said braking assembly is mounted to pivot together with said pivotable plate and wherein said device further comprises means for realigning said pivotable plate upon release of said boot.

2. The device as defined by claim 1 wherein said braking elements are adapted to extend beneath the plane of said ski when in the active position and to be raised above the lower plane of the ski to the inactive position as said boot is mounted on said ski.

3. The device as defined by claim 2 wherein each of said braking elements are adapted to be mounted so as to pivot around an axis substantially perpendicular to said axis of said plate which extends between said first maintenance element and said second maintenance element when said device is set to receive said boot.

4. The device as defined by claim 3 wherein said at least one boot-sensitive element comprises at least one metallic elastically deformable buckle arranged above said plate and pivotably mounted thereto whereby the end of said boot adapted to be received by said second maintenance element contacts said buckle when held by said second maintenance element.

5. The device as defined by claim 2 wherein at least one of said braking elements cooperate with said at least one boot-sensitive element, both of said one of said braking elements and said at least one boot-sensitive element being mounted on said pivotable plate by means of a single attachment means.

6. The device as defined by claim 5 wherein said one of said braking elements and said at least one boot-sensitive element is adapted such that pivoting of said at least one boot-sensitive element causes said corresponding braking element to pivot.

7. The device as defined by claim 2 wherein at least one of said braking elements and said at least one boot-sensitive element together comprise at least one bent metallic wire comprising a buckle arranged above said pivotable plate, said wire comprising two shafts arranged in the plain of said pivotable plate, each of said shafts being spaced from one another, at least one of said shafts being pivotably mounted in said plate; and wherein at least one of said braking elements comprise a shaft adapted to extend beyond the lateral edges of said ski to form a downwardly extending protrusion at the end of said extended shaft.

8. The device as defined by claims 2,3,4,5 or 7 wherein said device is mounted on said ski.

9. A device comprising:

(a) a first maintenance element;

(b) a pivotable plate, adapted to pivot around an axis substantially perpendicular to a ski while remaining secured to said ski, and comprising a second maintenance element; wherein said first maintenance element and said pivotable plate are each adapted to be mounted on a ski such that said first maintenance element and said second maintenance element serve to securely maintain the ends of a boot mounted on said ski while laterally releasing said boot when said boot is subjected to a torsional force relative to said ski; and (c) a braking assembly adapted to pivot together with said pivotable plate, said assembly comprising:

(i) two independent braking elements adapted to shift between active and inactive positions, said braking elements being positioned behind said axis on either lateral side of said ski and normally biased to the active position; and (ii) at least one boot-sensitive element adapted to shift the braking elements to the inactive position as said boot is mounted on said ski, wherein said device further comprises;

(iii) first stopping means for limiting rotation of said plate, adapted to cooperate with at least one of said braking elements when said braking assembly is in the active position so as to limit pivoting of said pivotable plate, wherein said device further comprises means for realigning said plate in response to release of said boot.

10. The device as defined by claim 9 wherein said braking elements are adapted to extend beneath the plane of said ski and to be raised above the lower plane of the ski as said boot is mounted on said ski.

11. The device defined by claim 10 wherein said first and second maintenance elements are longitudinally spaced along said ski and said stopping means cooperates with at least one of said braking elements and is integrally attached to said ski when said braking assembly is in the active position so as to maintain the pivoting plate in a position substantially aligned with the longitudinal axis of said ski.

12. The device defined by claim 9 wherein said realigning means returns said pivotable plate to the centered position ready for insertion of said boot after said pivotable plate has been rotated.

13. The device as defined by claim 12 wherein said realigning means comprises at least one ramp adapted to be fixed onto the upper surface of said ski and said ramp is adapted to extend from the center longitudinal axis of said ski to one of its lateral edges.

14. The device as defined by claim 13 wherein said braking assembly is adapted to cooperate with said ramp to return said pivotable plate to the centered position.

15. The device as defined by claim 13 wherein said ramp is an upstanding guiding member adapted to be mounted on said ski.

16. The device as defined by claim 15 wherein the surface of said upstanding guiding member is upwardly inclined from each outer end of said member to its center.

17. The device as defined by claim 9 wherein said stopping means comprises a lateral edge of the ski adapted to cooperate with at least one of said braking elements so as to maintain the pivotable plate in the centered position.

18. The device as defined by claim 17 wherein said two braking elements are adapted to pivot independently of one another and each of said two braking elements is adapted to be arranged along each of the two lateral edges of the ski.

19. The device as defined by claim 9 further comprising second stopping means comprises a stop adapted to be secured integral with said ski and adapted to limit the rotation of said pivotable plate when said braking elements are in the inactive position.

20. The device as defined by claim 19 wherein said stop is adapted to cooperate with at least one brakage element.

21. The device as defined by claim 20 wherein said aligning means comprises an upstanding ramp and wherein said stop is mounted at the apex of said ramp.

22. The device as defined by claim 19 wherein said stop is adapted to cooperate with said pivotable plate.

23. A device adapted to be mounted on a ski, said device comprising:

(a) a first maintenance element;

(b) a pivotable plate, adapted to be aligned, misaligned, and realigned with said ski and adapted to pivot around an axis substantially perpendicular to said ski while remaining secured to said ski comprising a second maintenance element; wherein said first maintenance element and said pivotable plate are each adapted to be mounted on a ski such that said first maintenance element and said second maintenance element may serve to securely maintain the ends of a ski boot mounted on said ski while laterally releasing said boot when said boot is subjected to a torsional force relative to said ski and (c) a braking assembly comprising:

(i) two independent braking elements adapted to shift between active and inactive positions, said braking elements being positioned behind said axis and on either lateral side of said ski and normally biased to the active position; and (ii) at least one boot-sensitive element adapted to shift said braking elements to the inactive position as said boot is mounted on said ski;

wherein said braking assembly is adapted to be mounted directly on said ski and wherein said device further comprises means for realigning said plate upon release of said boot.

24. A device mounted on a ski, said device comprising:

(a) a pivotable plate adapted to be aligned, misaligned and realigned with said ski, wherein said pivotable plate is mounted to pivot around an axis substantially perpendicular to said ski while remaining secured to said ski when subjected to torsional forces by a ski boot on said pivotable plate, wherein said pivotable plate allows for the lateral release of said boot when said boot is subjected to a torsional force relative to said ski; and (b) a braking assembly comprising:

(i) two independent braking elements adapted to shift between active and inactive positions, said braking elements being positioned behind said pivot axis and on either lateral side of said ski and normally biased to the active position; and (ii) at least one boot-sensitive element adapted to shift said braking elements to the inactive position as said boot is mounted on said ski, wherein said braking assembly is adapted to pivot together with said pivotable plate and wherein said device further comprises means for realigning said plate upon release of said boot.

25. A device adapted to be mounted on a ski, said device comprising:

(a) first and second maintenance elements adapted to secure a boot to said ski;

(b) a pivotable plate mounted to pivot around an axis substantially perpendicular to said ski while remaining secured to said ski when subjected to torsional forces by a ski boot on said pivotable plate; whereby said pivotable plate allows for the lateral release of said boot when said boot is subjected to a torsional force relative to said ski; and (c) a braking assembly comprising:

(i) two independent braking elements adapted to shift between active and inactive positions, said braking elements positioned behind said pivot axis and on either lateral side of said ski and normally biased to the active position; and (ii) at least one boot-sensitive element adapted to shift said braking elements to the inactive position as said boot is mounted on said ski;

and wherein said braking assembly is adapted to realign said pivotable plate when misaligned in response to a force applied to said braking assembly upon release of said boot to facilitate insertion of said boot into secured relationship with said first and second maintenance elements.

26. A device adapted to be mounted on a ski, said device comprising:

(a) a first maintenance element;

(b) a pivotable plate, adapted to pivot around an axis substantially perpendicular to said ski while remaining secured to said ski, and comprising a second maintenance element, wherein said first maintenance element and said pivotable plate are each adapted to be mounted on a ski such that said first maintenance element and said second maintenance element may serve to securely maintain the ends of a ski boot mounted on said ski while laterally releasing said boot when said boot is subjected to a torsional force relative to said ski; and (c) a braking assembly comprising:

(i) two independent braking elements being positioned behind said axis on either lateral side of said ski and normally biased to the active position; and (ii) at least one boot-sensitive element adapted to shift the braking elements to the inactive position as said boot is mounted on said ski;

wherein said braking assembly pivots around the same axis as said pivotable plate and wherein said device further comprises means for realigning said plate when said plate is misaligned upon release of said boot.

27. A device adapted to be mounted on a ski, said device comprising:

(a) a first maintenance element;

(b) a pivotable plate, adapted to pivot around an axis substantially perpendicular to said ski while remaining secured to said ski, and comprising a second maintenance element, wherein said first maintenance element and said pivotable plate are each adapted to be mounted on a ski such that said first maintenance element and said second maintenance element may serve to securely maintain the ends of a ski-boot mounted on said ski while laterally releasing said boot when said boot is subjected to a torsional force relative to said ski; and (c) a braking assembly adapted to pivot together with said pivotable plate, said assembly comprising:

(i) two independent braking elements adapted to shift betwen an active position and an inactive position, said braking elements being positioned behind said axis on either lateral side of said ski and normally biased to the active position;

(ii) at least one boot-sensitive element adapted to shift the braking elements to the inactive position as said boot is mounted on said ski; and (iii) stopping means for limiting rotation of said plate, adapted to cooperate with at least one braking element and further adapted to be secured integral with said ski, when said braking assembly is in the inactive position so as to limit pivoting of said pivotable plate, wherein said device further comprises means for realigning said plate in response to release of said boot.

28. The device defined by claim 9 wherein said aligning means comprises upstanding ramp, wherein said stopping means is mounted at the apex of said ramp.

29. A device adapted to be mounted on a ski, said device comprising:

(a) a first maintenance element;

(b) a pivotable plate, adapted to pivot around an axis substantially perpendicular to said ski while remaining secured to the ski and comprising a second maintenance element, wherein said first maintenance element and said pivotable plate are each adapted to be mounted on a ski such that said first and second maintenance elements may serve to securely maintain the ends of a ski boot mounted on said ski while laterally releasing said boot when said boot is subjected to a torsional force relative to said ski; and (c) a braking assembly comprising:

(i) two independent braking elements adapted to shift between active and inactive positions, said braking elements being positioned behind said axis on either lateral side of said ski and normally biased to the active position; and (ii) at least one boot-sensitive element adapted to shift the braking elements to the inactive position as said boot is mounted on said ski, wherein said braking assembly is arranged such that it pivots together with said pivotable plate and wherein said device further comprises means for maintaining said plate aligned with said ski during insertion of said boot into at least one of said maintenance elements.

30. The device defined by claims 1, 23, 24, or 26 wherein said ski is adapted to be displaced down a ski slope on snow, wherein said braking elements comprise a portion for contacting and being displaced with respect to said snow down said slope in response to pivoting of said plate and release of said boot, wherein said contact and displacement with respect to said snow as said braking elements are displaced down said slope generates a force on said braking assembly toward said ski, wherein said braking assembly, said plate pivot, and said ski pivot with respect to each other so that said plate is realigned with said ski in response to said force on said braking assembly.

31. The device defined by claim 9 in combination with said ski, wherein said first stopping means comprises the side of said ski.

32. The device defined by claim 31 wherein in said active position at least one braking element is mounted on said plate and extends below and is spaced laterally from the side of said ski, wherein said side of said ski limits lateral displacement of at least one braking element in said active position, thereby limiting lateral displacement of said plate.

33. The device defined by claim 23 wherein said first maintenance element is spaced from said pivotable plate.

34. The device defined by claim 9 wherein one of said braking elements is positioned in said active position and the other of said braking elements is positioned in said inactive position in response to release of said boot, wherein said first stopping means comprises a stop mounted on said ski, wherein said other of said braking elements is adapted to engage said stop upon release of said boot so as to limit rotation of said plate.

35. A device adapted to be mounted on a ski, said device comprising:

(a) a first maintenance element;

(b) a pivotable plate, adapted to pivot around an axis substantially perpendicular to said ski while remaining secured to said ski and comprising a second maintenance element, wherein said first maintenance element and said pivotable plate are each adapted to be mounted on said ski such that said first maintenance element and said second maintenance element are adpated to securely maintain the ends of a ski boot mounted on said ski while laterally releasing said ski boot when said ski boot is subjected to a torsional force relative to said ski; and (c) a braking assembly comprising:

(i) two independent braking elements adapted to shift between active and inactive positions, said braking elements being positioned behind said axis on either lateral side of said ski and normally biased to the active position such that said braking elements extend below said ski in said active position during insertion of said ski boot, wherein contact between said braking elements and the side of said ski limit pivoting of said braking elements in said active position during insertion of said ski boot, thereby maintaining said plate aligned with said ski during insertion of said ski boot into at least one of said maintenance elements wherein said braking elements are adapted to maintain said plate aligned with said ski during insertion of said ski boot into at least one of said maintenance elements; and (ii) at least one boot-sensitive element adapted to shift the braking elements to the inactive position as said ski boot is mounted on said ski, wherein said braking assembly is arranged such said it pivots together with said pivotable plate.

36. A device adapted to the mounted on a ski, wherein said ski is adapted for travel down a slope on snow, said device comprising:

(a) a first maintenance element;

(b) a pivotable plate adapted to be aligned with said ski, and adapted to pivot around an axis substantially perpendicular to said ski while remaining secured to said ski, said pivotable plate comprising a second maintenance element wherein said first maintenance element and said pivotable plate are adapted to be mounted on a ski such said first maintenance element and said second maintenance element are adapted to securely maintain the ends of a ski boot mounted on said ski while laterally releasing said ski boot when said ski boot is subjected to a torsional force relative to said ski thereby misaligning said plate; and (c) a braking assembly comprising:

(i) two independent braking elements adapted to shfit between active and inactive positions, said braking elements being positioned behind said axis on either lateral side of said ski and normally biased to the active position, wherein said pivotable plate is realigned upon release of said ski boot and wherein said two braking elements are displaced into said active position into contact with said snow in response to release of said ski boot, whereby contact between said braking elements and said snow during travel of said ski down said slope on said snow realigns said braking elements and said pivotable plate with said ski upon release of said ski boot; and (ii) at least one boot-sensitive element adapted to shift the braking elements to the inactive position as said ski boot is mounted on said ski;

and wherein said braking assembly is mounted to pivot together with said pivotable plate.

37. A device adapted to be mounted on a ski, said device comprising:

(a) a first maintenance element;

(b) a pivotable plate adapted to be aligned with said ski, and adapted to pivot around an axis substantially perpendicular to said ski while remaining secured to said ski, said pivotable plate comprising a second maintenance element wherein said first maintenance element and said pivotable plate are each adapted to be mounted on a ski such that said first maintenance element and said second maintenance element may serve to securely maintain the ends of a ski boot mounted on said ski while laterally releasing said ski boot when said ski boot is subjected to a torsional force relative to said ski thereby misaligning said plate; and (c) a braking assembly comprising:

(i) two independent braking elements adapted to shift between active and inactive positions, said braking elements being positioned behind said axis on either lateral side of said ski and normally biased to the active position, said braking assembly further comprising a ramp, said braking assembly and said ramp being adapted to realign said pivotable plate upon release of said ski boot, wherein one of said braking elements is displaced into said inactive position in contact with said ramp in response to release of said ski boot, whereby said one of said braking elements is displaced by said ramp so as to realign said braking elements and said plate with said ski in response to release of said ski boot; and (ii) at least one boot-sensitive element adapted to shift the braking elements to the inactive position as said ski boot is mounted on said ski;

and wherein said braking assembly is mounted to pivot together with said pivotable plate.

* * * * *

UNITED STATES PATENT AND TRADEMARK OFFICE

CERTIFICATE OF CORRECTION

PATENT NO. : 4,754,990

DATED : July 5, 1988

INVENTOR(S) : GEORGES SALOMON

It is certified that error appears in the above-identified patent and that said Letters Patent is hereby corrected as shown below:

At column 1, line 43, change "comprise" to ---comprises---.

At column 1, line 64, delete "be" after "additionally".

At column 2, line 49, change 'FIGS." to ---FIG.---.

At column 2, line 55, change "illustrate" to ---illustrates---.

At column 4, line 25, change "needs" to ---need---.

At column 5, line 53, change "that in," to ---that, in---.

At column 6, line 36, change "embodiment" to ---embodiments---.

At column 7, line 14, change "FIG." to ---FIGS.---.

At column 7, line 29, change "occurres" to ---occurs---.

At column 7, line 59, change "maintainance" to ---maintenance---.

At column 7, line 63, change "is" to ---in--- after "which".

At column 8, line 8, delete "of this".

At column 8, line 23, change "types" to ---type---.

At column 8, line 58, change ". Furthermore" to ---, and further more---.

At column 8, line 65, change "constitue" to ---constitutes---.

At column 9, line 54, change "cooperate" to ---cooperates---.

At column 9, line 61, change "is" to ---are---.

At column 10, line 1, change "plain" to ---plane---.

UNITED STATES PATENT AND TRADEMARK OFFICE

CERTIFICATE OF CORRECTION

PATENT NO. : 4,754,990

DATED : July 5, 1988

INVENTOR(S) : GEORGES SALOMON

It is certified that error appears in the above-identified patent and that said Letters Patent is hereby corrected as shown below:

At column 14, line 63, change "said" to ---that---.
At column 15, line 16, change "shfit" to ---shift---.

Signed and Sealed this

First Day of December, 1992

*Attest:*

DOUGLAS B. COMER

*Attesting Officer*

*Acting Commissioner of Patents and Trademarks*